US007154216B2

(12) United States Patent
Kamiguchi

(10) Patent No.: US 7,154,216 B2
(45) Date of Patent: Dec. 26, 2006

(54) DISPLAY DEVICE, HERMETIC CONTAINER, AND METHOD FOR MANUFACTURING HERMETIC CONTAINER

(75) Inventor: Kinya Kamiguchi, Tokyo (JP)

(73) Assignee: Canon Kanushiki Kaisha, Tokyo (JP)

( * ) Notice: Subject to any disclaimer, the term of this patent is extended or adjusted under 35 U.S.C. 154(b) by 0 days.

(21) Appl. No.: 11/242,845

(22) Filed: Oct. 5, 2005

(65) Prior Publication Data

US 2006/0028119 A1 Feb. 9, 2006

Related U.S. Application Data

(62) Division of application No. 10/934,491, filed on Sep. 7, 2004, now Pat. No. 6,967,434, which is a division of application No. 10/351,482, filed on Jan. 27, 2003, now Pat. No. 6,858,980.

(30) Foreign Application Priority Data

Jan. 31, 2002 (JP) ..... 2002-023555

(51) Int. Cl.
*H01J 1/88* (2006.01)

(52) U.S. Cl. ..... 313/495; 313/422; 313/491; 313/631; 313/326

(58) Field of Classification Search ..... 313/495–497, 313/309–311, 346 R, 336, 326, 483, 351, 313/493, 422, 503, 574, 631, 491, 573, 634
See application file for complete search history.

(56) References Cited

U.S. PATENT DOCUMENTS

| | | | | |
|---|---|---|---|---|
| 3,845,347 | A | 10/1974 | Tanji | 313/483 |
| 3,883,768 | A * | 5/1975 | Voinov et al. | 313/358 |
| 5,463,276 | A | 10/1995 | Kawasaki et al. | 313/496 |
| 5,965,978 | A | 10/1999 | Kishino et al. | 313/496 |
| 6,114,804 | A | 9/2000 | Kawase et al. | 313/495 |
| 6,407,500 | B1 | 6/2002 | Tsuburaya et al. | 313/495 |
| 6,476,547 | B1 | 11/2002 | Kawase | 313/495 |
| 6,528,939 | B1 | 3/2003 | Kawase | 313/495 |
| 6,603,255 | B1 | 8/2003 | Takahashi | 313/496 |
| 6,831,402 | B1 | 12/2004 | Kamiguchi | 313/495 |
| 6,858,981 | B1 * | 2/2005 | Cho et al. | 313/495 |
| 2003/0025443 | A1 | 2/2003 | Kamiguchi | 313/495 |
| 2003/0137235 | A1 | 7/2003 | Yamanobe et al. | 313/495 |

FOREIGN PATENT DOCUMENTS

| | | |
|---|---|---|
| JP | 5-114372 | 5/1993 |
| JP | 9-45266 | 2/1997 |
| JP | 2000-251801 | 9/2000 |

* cited by examiner

*Primary Examiner*—Ashok Patel
(74) *Attorney, Agent, or Firm*—Fitzpatrick, Cella, Harper & Scinto

(57) ABSTRACT

In order to ensure hermeticity of a hermetic container and to suppress occurrence of electrical leakage, a display device is provided with a faceplate including an anode to be supplied with an externally-supplied electric potential, a rear plate arranged facing the faceplate at a predetermined spacing therefrom, a metal pin for supplying the electric potential to the anode from outside of the rear plate through a penetration hole in the rear plate, wherein the penetration hole includes the metal pin by insertion. The metal pin includes an axis portion disposed in the penetration hole and a flange portion which is integral with this axis portion and which is located adjacent an opening end of the penetration hole. The flange portion is joined to the rear plate for hermetically sealing the penetration hole.

3 Claims, 7 Drawing Sheets

DISPLAY DEVICE, HERMETIC CONTAINER, AND METHOD FOR MANUFACTURING HERMETIC CONTAINER

This application is a division of U.S application Ser. No. 10/934,491, filed Sep. 7, 2004, now U.S. Pat. No. 6,967,434 B2, issued Nov. 22, 2005, which is a division of U.S. application Ser. No. 10/351,482, filed Jan. 27, 2003, now U.S. Pat. No. 6,858,980 B2, issued Feb. 22, 2005.

BACKGROUND OF THE INVENTION

1. Field of the Invention

The present invention relates to a display device, for example, a display of a television receiver, computer, or the like, for displaying information of characters, images, etc., and a message board for displaying characters. Furthermore, the present invention relates to a hermetic container arranged in the display device and a method for manufacturing the hermetic container.

2. Description of the Related Art

Examples of known conventional flat-panel display devices include surface conduction electron emission display devices (hereafter referred to as SEDs) disclosed in, for example, Japanese Patent Laid-Open No. 2000-251801, U.S. Pat. No. 6,114,804, and Japanese Patent Laid-Open No. 09-045266, and a field emission display device (hereafter referred to as an FED) disclosed in Japanese Patent Laid-Open No. 05-114372.

FIG. 8 shows a perspective view of an FED 101. This FED will be briefly described with reference to the drawing.

The FED 101 is provided with a hermetic container as a display portion for displaying information, for example, images. As shown in FIG. 8, this hermetic container has a low-profile flat-panel configuration in which insulation layers 111 and 112 are held between a front panel 106 provided with a power supply conductive layer 108 as an anode and a back panel 107 provided with cathodes 109 as electron-emission members, and are sealed. This hermetic container is sealed while being in the condition that inside air has been sucked out using an exhaust pipe (not shown in the drawing) communicated to a suction pump (also not shown) and, therefore, has a vacuum structure.

The hermetic container is provided with a hole portion 116 containing by insertion a fluorescent screen potential feeding terminal 114 having an elastomer 115 at the tip in the back panel 107 in order to apply a voltage to the power supply conductive layer 108. A terminal lead-out portion 117 arranged on a base end side of the fluorescent screen potential feeding terminal 114 contained in the hole portion 116 by insertion is drawn out of the hole portion 116 and, in addition, this hole portion 116 and the terminal lead-out portion 117 are hermetically covered with a sealing material 118, so that the hermetic container is sealed.

Regarding the FED 101 including the hermetic container configured as described above, electrons are emitted from the cathodes 109 by applying a voltage between the power supply conductive layer 108 and the cathodes 109. In the FED 101, emitted electrons allow a fluorescent screen 120 to emit light so as to form pixels, and images are displayed on the front panel 106.

As described above, the hermetic container arranged in the conventional display device has to be sealed by covering the hole portion, the terminal lead-out portion of the fluorescent screen potential feeding terminal, and the like, with the sealing member, such as, for example, a sealing material, in order to maintain the inside of the container in a vacuum condition.

SUMMARY OF THE INVENTION

It is an object of the present invention to realize a configuration for supplying an electric potential to an electrode arranged inside a hermetic container, and in addition a configuration allowing the hermetic container to maintain hermeticity with ease.

It is another object of the present invention to realize a configuration capable of easily regulating an electric potential of an opening end of a penetration hole for supplying an electric potential to an inside of the hermetic container.

An aspect of the present invention is described below. A display device according to the present invention is a display device provided with a cathode for emitting electrons and an electrode to be supplied with an externally-applied or derived (supplied) electric potential. The display device includes a first substrate provided with the electrode, a second substrate arranged facing this first substrate at a predetermined spacing (between the substrates), a first conductive member for supplying an electric potential to the electrode (from an outer surface side of this second substrate through the second substrate), and a penetration hole which is arranged in the second substrate and through which the first conductive member is inserted. The first conductive member includes a first, axis portion, at least a portion of which extends through the penetration hole, and a second portion which is integral with the first, axis portion and which is located adjacent an opening end of the penetration hole. The second portion of this first conductive member is joined to the second substrate while hermetically blocking (sealing) the penetration hole.

In the display device configured as described above, the configuration in which the first portion and the second portion of the first conductive member are integral with each other refers to a configuration in which the first portion and the second portion of the first conductive member are at least electrically connected and/or formed as a single body, and in addition, refers to a configuration in which no joint is included in a portion subjected to a pressure difference between a pressure of a space between the first substrate and the second substrate and a pressure adjacent the outer surface (i.e., outside) of the second substrate. That is, in a configuration in which the first portion and the second portion are arranged separately, these portions are joined to each other, and a joint portion thereof is subjected to the aforementioned pressure difference, and hermeticity of the joint portion must be ensured adequately. However, according to the present invention, regarding the first conductive member, breakage of hermeticity in the first conductive member itself can be suppressed because no joint is included in a portion subjected to the aforementioned pressure difference.

In the display device according to the present invention, the second portion is hermetically joined to the outer surface of the second substrate.

The display device according to the present invention may be provided with a second conductive member electrically connected to the first conductive member. Preferably, the second conductive member is in contact with an opening end of the penetration hole and is disposed on an inner surface of the second substrate. According to this configuration, the electric potential of the opening end (periphery) of the penetration hole in the inner surface of the second substrate can be regulated. In particular, in a preferred embodiment of the invention, the configuration is suitable to arrange a conductive film at the opening end of the penetration hole in the inner surface of the second conductive member and to bring this conductive film and the second substrate into contact with each other.

Preferably, the display device according to the present invention is provided with a conductive flexible member which is arranged at a location between the first conductive member and the electrode and which is electrically connected to each of the first conductive member and the electrode. According to this configuration, since the conductive flexible member deforms, the electrical connection between the first conductive member and the electrode can be established with reliability even when there is an error or inaccuracy in the spacing between the first substrate and the second substrate. As the conductive flexible member, a spring may be used, and a helical compression spring preferably is used. However, the conductive flexible member need not be limited to a spring as long as the member can be deformed in accordance with the dimensions of the spacing between the first substrate and the second substrate when these substrates are assembled.

In the display device according to the present invention, a suitable absolute value of the difference between a thermal expansion coefficient of a base material of the first conductive member and a thermal expansion coefficient of the second substrate is $3.0\times10^{-6}/°$ C. or less. According to this aspect of the invention, occurrence of thermal stress at a junction surface of the second substrate and the first conductive member can be suitably suppressed. Consequently, peeling of the first conductive member from the second substrate can be suppressed, and an excellent junction can be realized. A substrate having a thermal expansion coefficient of $5.0\times10^{-6}/°$ C. or more, but $9.0\times10^{-6}/°$ C. or less, is suitable as the second substrate. The first conductive member may be composed of a base material having a thermal expansion coefficient of $2.0\times10^{-6}/°$ C. or more, but $12.0\times10^{-6}/°$ C. or less, and, furthermore a suitable absolute value of the difference of that thermal expansion coefficient from the thermal expansion coefficient of the second substrate is $3.0\times10^{-6}/°$ C. or less. As the base material, metals (including alloys) and glass may be adopted. When the base material is an insulation material, conductivity can be imparted by making a surface conductive, for example, conductive plating.

Preferably, the second portion of the first conductive member arranged in the display device according to the present invention is provided with a film for improving wettability with respect to a joining material on a joint portion joined to the second substrate with the joining material therebetween. The term "wettability" means the ability of an element to join with another element when in a melted condition. The wettability is one kind of affinity. As the film for improving wettability, for example, plating may be employed and, in particular, gold plating may be employed.

In the display device according to the present invention, preferably the joining material is made of a metallic material. The metallic material may be an alloy. Furthermore, low-melting point glass, for example, may be used as a material other than the metallic material.

In the display device according to the present invention, the electrode is supplied with an electric potential for accelerating electrons emitted from the cathode.

Another aspect of the present invention is described below. In accordance with this aspect of the invention, another display device is provided with a cathode for emitting electrons and an electrode to be supplied with an externally-applied or derived electric potential, the display device includes a first substrate provided with the electrode, a second substrate arranged facing this first substrate at a certain spacing (between the substrates), a penetration hole which is arranged in the second substrate and through which an electric potential is supplied to the electrode from an outer surface side (i.e., outside) of the second substrate, and a conductive member arranged between this penetration hole and the electrode. The conductive member is supplied with an electric potential from adjacent the outer surface side (i.e., outside) of the second substrate, and is in contact with an opening end of the penetration hole, and disposed on an inner surface of the second substrate.

According to the display device of the present invention, since the conductive member is brought into contact with the opening end of the penetration hole on the inner surface side of the second substrate, the electric potential of a contact portion brought into contact can be regulated.

Preferably, the second substrate arranged in the display device according to the present invention is provided with a conductive film on the contact portion with the conductive member.

The display device according to the present invention may be provided with a conductive flexible member arranged at a location between the conductive member and the electrode. Preferably, this conductive flexible member is electrically connected to each of the conductive member and the electrode.

Another aspect of the present invention is described below. That is, a hermetic container according to an embodiment of the present invention has an internal pressure lower than an external pressure and includes therein an electrode to be supplied with an externally-applied or derived (supplied) electric potential. The hermetic container includes a first substrate provided with the electrode, a second substrate arranged facing the first substrate at a predetermined spacing (between the substrates), a conductive member for supplying the electric potential to the electrode from adjacent an outer surface side (i.e., outside) of the second substrate through the second substrate, and a penetration hole which is arranged in the second substrate and which includes the conductive member by insertion. The conductive member includes a first portion, at least part of which is located in the penetration hole, and a second portion which is integral with the first portion and which is located at an opening end of the penetration hole. The second portion of this conductive member is joined to the second substrate while hermetically blocking the penetration hole.

Another aspect of the present invention is described below. Another hermetic container according to the present invention has an internal pressure lower than an external pressure and includes therein an electrode to be supplied with an externally-applied or derived (supplied) electric potential. The hermetic container includes a first substrate provided with the electrode, a second substrate arranged facing the first substrate at a predetermined spacing (between the substrates), a penetration hole which is arranged in the second substrate and through which is supplied an electric potential to the electrode from an outer surface side (i.e., outside) of the second substrate, and a conductive member arranged at a location between the penetration hole and the electrode. The conductive member is supplied with an electric potential from adjacent the outer surface side (i.e., outside) of the second substrate, and is in contact with an opening end of the penetration hole on an inner surface of the second substrate.

Another aspect of the present invention is described below. In accordance with this aspect of the invention, a method for manufacturing a hermetic container provided with an electrode therein is provided. The method includes a first step of affixing a lid for sealing a penetration hole arranged in the hermetic container, to a joining device, bringing the lid and an opening end of the penetration hole into contact with each other with a joining material disposed between an outer surface of the hermetic container and the lid, joining the lid to the outer surface by melting the joining material, and thereby substantially hermetically sealing the penetration hole, and a second step of separating the lid joined to the outer surface from the joining device.

The method for manufacturing a hermetic container according to the present invention may include a step of diffusion-joining the lid and the outer surface with the joining material therebetween by ultrasonic vibration using the joining device provided with a generation device for generating the ultrasonic vibration.

As used herein, the term inner surface of the second substrate refers to a front surface of the second substrate facing the first substrate, and the term outer surface of the second substrate refers to a back surface located on a back side of the display device, facing outside of the device.

As a matter of course, the hermetic container and the method for manufacturing a hermetic container according to the present invention may be configured based on combination with the display device according to the present invention or at least one of the other embodiments of the invention related to this display device.

Further objects, features and advantages of the present invention will become apparent from the following description of the preferred embodiments with reference to the attached drawings.

DESCRIPTION OF THE PREFERRED EMBODIMENTS

Regarding specific embodiments of the present invention, low-profile flat-panel display devices will be described below with reference to the drawings.

(First Embodiment)

Figure 1:
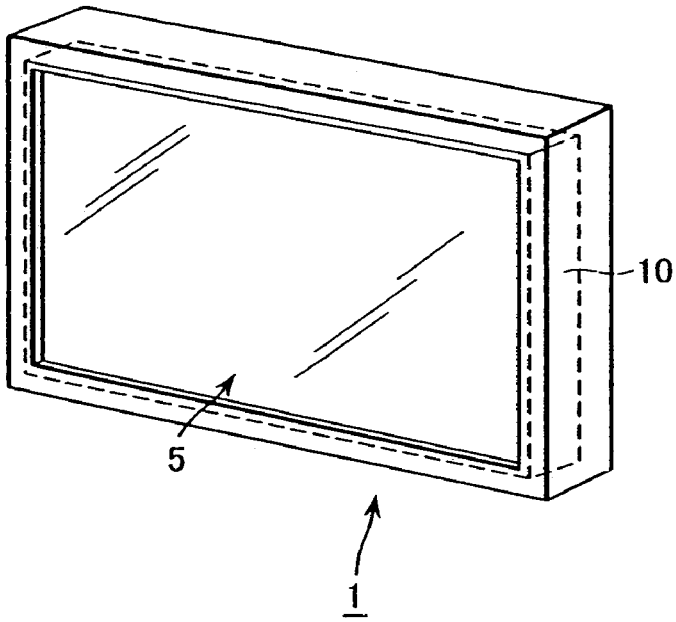
FIG. 1 is a perspective view showing a display device according to a first embodiment of the present invention.

As shown in FIG. 1, a display device 1 includes a display portion 5 for displaying various information, for example, characters and images. The display device 1 is provided with a control portion (not shown in the drawing) for controlling driving of the display portion 5, a support frame (not shown in the drawing) for supporting the display portion 5 and the control portion, and a cover 8 which is a casing covering the display portion 5, control portion, and support frame.

Figure 2:
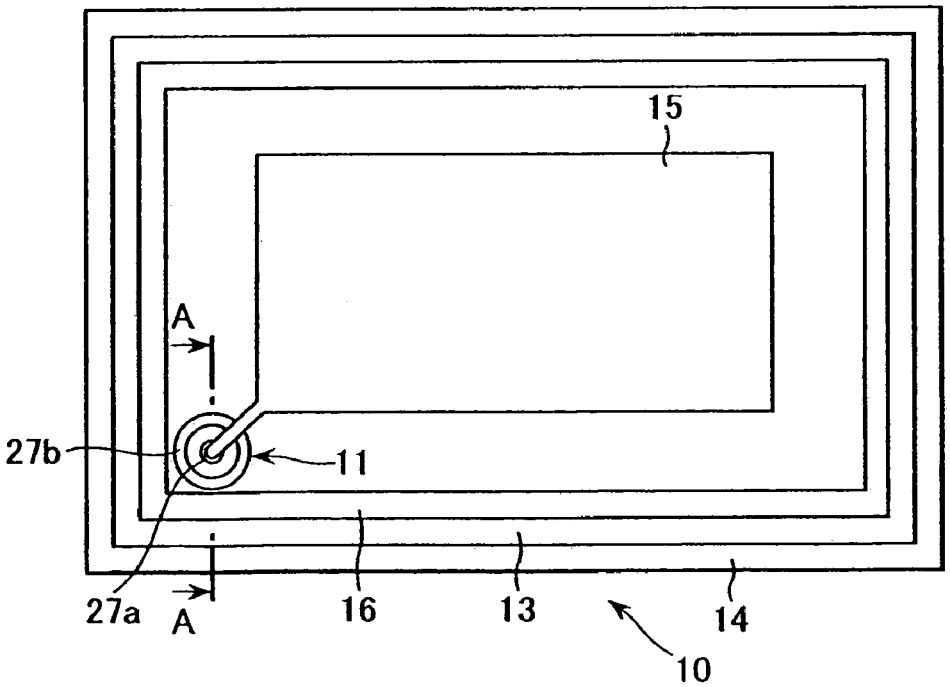
FIG. 2 is a front view showing a hermetic container arranged in the aforementioned display device, as viewed from a perspective looking towards a front side of the container.
Figure 3:
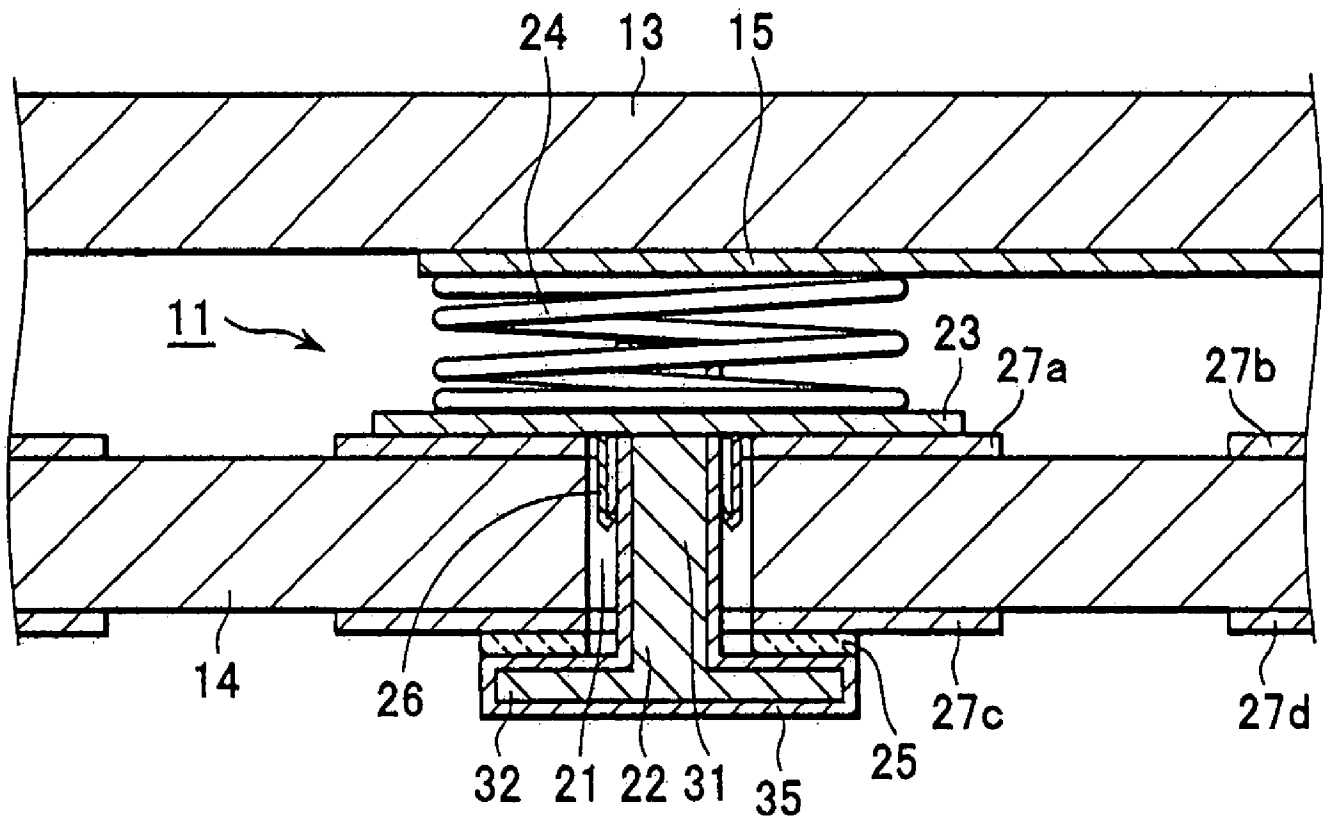
FIG. 3 is a sectional view of a section of a voltage application structure, taken along a line A—A shown in FIG. 2.

Referring also to FIG. 2 and FIG. 3, the display device 1 includes a hermetic container 10 with an inside thereof being kept hermetic and a voltage application structure 11 which is a power supply structure for supplying an electric potential from the external atmosphere (environment) into this hermetic container 10.

As shown in FIG. 2, the hermetic container 10 includes a faceplate (anode substrate) 13 provided with an anode 15 on a main surface of the faceplate 13, a rear plate (cathode substrate) 14 provided with a cathode (not shown in the drawing) capable of emitting electrons on the main surface, and a frame 16 and spacers (not shown in the drawing) held in a facing gap between these faceplate 13 and rear plate 14 facing each other.

The faceplate 13 and the rear plate 14 are formed from, for example, a glass material having a thermal expansion coefficient of $8.0\times10^{-6}$/° C. to $9.0\times10^{-6}$/° C., to have a thickness on the order of 2.8 mm. The frame 16 is formed from, for example, a glass material of the same sort as that of the glass material constituting the faceplate 13 and the rear plate 14, to have a thickness on the order of 1.1 mm. The frame 16 and spacers (not shown in the drawing) are arranged in the facing gap between the faceplate 13 and the rear plate 14 by adhesion.

The faceplate 13, the rear plate 14, and the frame 16 are adhered using frit (not shown in the drawing), and the hermeticity between the faceplate 13 and the rear plate 14 is ensured. Consequently, the inside of the hermetic container 10 is under a vacuum condition.

As shown in FIG. 3, a voltage application structure 11 in accordance with the present invention includes a penetration hole 21 arranged in the rear plate 14 of the hermetic container 10, a metal pin 22 (first conductive member) which is contained by insertion in this penetration hole 21 and which is for supplying an electric potential to the anode 15, a metal plate 23 electrically connected to this metal pin 22, a helical compression spring 24 (conductive elastic member) electrically connected to this metal plate 23, a joining material 25 for joining the metal pin 22 to the plate 14, and a socket 26 for electrically connecting the metal pin 22 and the metal plate 23.

Regarding opening ends of the penetration hole 21, an outer surface side metal paste 27*c* is annularly arranged on a back surface of the rear plate 14 (hereinafter referred to as an outer surface of the rear plate 14) located on a back side of the display portion 5, and an inner surface side metal paste 27*a* is annularly arranged on an opposite, front surface of the rear plate 14 (hereinafter referred to as an inner surface of the rear plate 14) facing the faceplate 13. Furthermore, as shown in FIG. 2 and FIG. 3, perimeter side pastes 27*b* and 27*d* are arranged on the inner and outer surfaces, respectively, of the plate 14, and separated from perimeter sides of these inner surface side metal paste 27*a* and outer surface side metal paste 27*c*, respectively.

The penetration hole 21 is formed to have a diameter on the order of 2 mm, and each of the pastes 27*a*, 27*b*, 27*c*, and 27*d* arranged at the perimeter thereof is formed by printing a paste material primarily containing silver and, thereafter, performing drying at 360° C. for 10 minutes and performing firing at 420° C. for 10 minutes.

The metal pin 22 includes an axis portion 31 which is a small diameter portion to be inserted through the penetration hole 21, and a nearly disk-shaped flange portion 32 which is a large diameter portion integrally arranged on a base end side of this axis portion 31. The metal pin 22 can be formed from a material, for example, a 42Ni-6Cr—Fe alloy (a thermal expansion coefficient of $7.5\times10^{-6}$/° C. to $9.8\times10^{-6}$/° C.). Here, a metal pin made of a Ni-6Cr—Fe alloy having a thermal expansion coefficient of $9.0\times10^{-6}$/° C. is used. The metal pin 22 is formed to have the axis portion 31 on the order of 0.5 mm in diameter and the flange portion 32 on the order of 5 mm in diameter. Regarding the metal pin 22, the thermal expansion is allowed to nearly agree with the thermal expansion of the glass material (a thermal expansion coefficient of $9.0\times10^{-6}$/° C.) which has formed the rear plate 14, and therefore any thermal stress generated during manufacture of the voltage application structure 11 is relaxed or at least substantially reduced.

Preferably, the material for the metal pin 22 is properly selected from metallic materials having thermal expansion coefficients of $2.0\times10^{-6}$/° C. to $12.0\times10^{-6}$/° C., for example, Invar alloy, 47Ni—Fe alloy (a thermal expansion coefficient of $3.0\times10^{-6}$/° C. to $5.5\times10^{-6}$/° C.), and 42Ni-6Cr—Fe alloy (a thermal expansion coefficient of $0.7.5\times10^{-6}$/° C. to $9.8\times10^{-6}$/° C.), in order to match the thermal expansion coefficient ($5.0\times10^{-6}$/° C. to $9.0\times10^{-6}$/° C.) of the glass material used for the rear plate 14 (to allow an absolute value of the difference in the thermal expansion coefficients to become $3.0\times10^{-6}$/° C. or less).

An outer surface of the metal pin 22 is covered with a conductive plating 35 for improving junction strength by improving wettability with respect to a joining material 25. As the conductive plating 35, for example, an electroless nickel plating on the order of 3 μm thick is applied, and thereafter electroless gold plating on the order of 0.05 μm thick is applied all over the metal pin 22. Preferably, the material for the conductive plating 35 is selected from, for example, gold, silver, nickel, and copper, in consideration of the wettability with respect to the joining material 25.

Flange portion 32 of the metal pin 22 is joined onto the outer surface of the rear plate 14 with the joining material 25 therebetween. As the joining material 25, for example, indium is used. By allowing only one place, between the metal pin 22 and the metal paste 27*c*, to become a junction surface of the voltage application structure 11, the probability of occurrence of electrical leakage and reduction of strength due to junction failure can be substantially minimized or reduced. Preferably, the material for the joining material is properly selected from, for example, indium, lead solder, and frit, in consideration of the wettability with respect to the metal paste 27*c* as a substrate.

The helical compression spring 24 is joined onto a main surface of the metal plate 23 by laser spot welding. The helical compression spring 24 is formed into dimensions of 7 mm in natural length and 4 mm in outer diameter from, for example, a stainless steel wire of 0.2 mm in wire diameter. Regarding the voltage application structure 11, since a structure of a helical compression spring is adopted, even when the length of the spring is reduced, a relatively large stroke can be achieved by increasing the pitch of spring. The term "stroke" means amount of displacement through compression. Consequently, the elastic force is allowed to function with stability even in a relatively small area specific to the low-profile flat-panel display device 1.

The metal plate 23 is manufactured by, for example, subjecting a stainless steel plate on the order of 5 mm in diameter and 0.05 mm in thickness to an etching treatment. This metal plate 23 includes a center hole (not shown in the drawing) for containing the axis portion 31 of the metal pin 22 by insertion. The socket 26 is formed into the shape of a cylinder from a conductive metallic material, and the socket 26 is arranged in the center hole of the metal plate 23 by engaging, fitting, or joining.

The metal plate 23 is positioned by fitting the axis portion 31 of the metal pin 22 into the socket 26, and after the faceplate 13 is arranged, the metal plate 23 is pressed against the rear plate 14 side by the helical compression spring 24 welded to the metal plate 23. The axis portion 31 is protruded at least partially inside the helical compression spring 24. As described above, the positioning is performed with further reliability so as to be arranged in a desired position.

Regarding the voltage application structure 11 configured as described above, a voltage is applied from adjacent the outer surface side (i.e., external or outside) of the rear plate 14, and is applied to the anode 15 via the metal pin 22 with the axis portion 31 being contained in the penetration hole 21 by insertion through the socket 26, metal plate 23, and helical compression spring 24.

Electrons emitted from the cathode on the rear plate 14 into a vacuum are accelerated by applying a voltage to the anode 15, and come into collision with fluorophors (fluorescent members) (not shown in the drawing) arranged on the anode 15 so as to bring about light emission. Consequently, information, for example, images, is displayed on the display portion 5 arranged in the display device 1.

Since the aforementioned voltage application structure 11 adopts a continuity structure in which the helical compression spring 24, socket 26, metal plate 23, and metal pin 22 are independent of one another, the helical compression spring 24 can be arranged regardless of precision in the arrangement position of the metal pin 22 relative to the rear plate 14, and therefore, the elastic force of the helical compression spring 24 can be exerted with stability. Furthermore, since the helical compression spring 24, socket 26, metal plate 23, and metal pin 22 are independent of one another in the configuration, the helical compression spring 24, socket 26, and metal plate 23 can be installed after the metal pin 22 is installed and, therefore, deformation during installation-processing of the metal pin 22 can be avoided and prevented.

Since the joining material 25 has electrical conductivity, the metal paste 27*c* has nearly the same electric potential as that of the metal pin 22, and the metal paste 27*a* is allowed to have nearly the same electric potential as that of the metal pin 22 by being brought into contact with the metal plate 23 having the same electric potential as that of the metal pin 22. On the other hand, the metal pastes 27*b* and 27*d* are grounded. This is for stabilizing the electric potential of the total voltage application structure 11 by enclosing with a conductive metal paste having a regulated voltage and, thereby, determining the reference of electric potential.

Regarding the voltage application structure 11, when structures, metal pin 22 and helical compression spring 24, are enclosed by virtue of, or sealed by, each of the metal pastes 27*a*, 27*b*, 27*c*, and 27*d* on the perimeter of the penetration hole 21, an electric field convergence which can occur at protrusion-shaped portions of structures, etc., resulting from the shape is alternatively brought to the metal pastes 27*a*, 27*b*, 27*c*, and 27*d* with end portions being likely to form into smooth shapes and, therefore, occurrence of discharge resulting from the electric field convergence can be suppressed.

Figure 4:
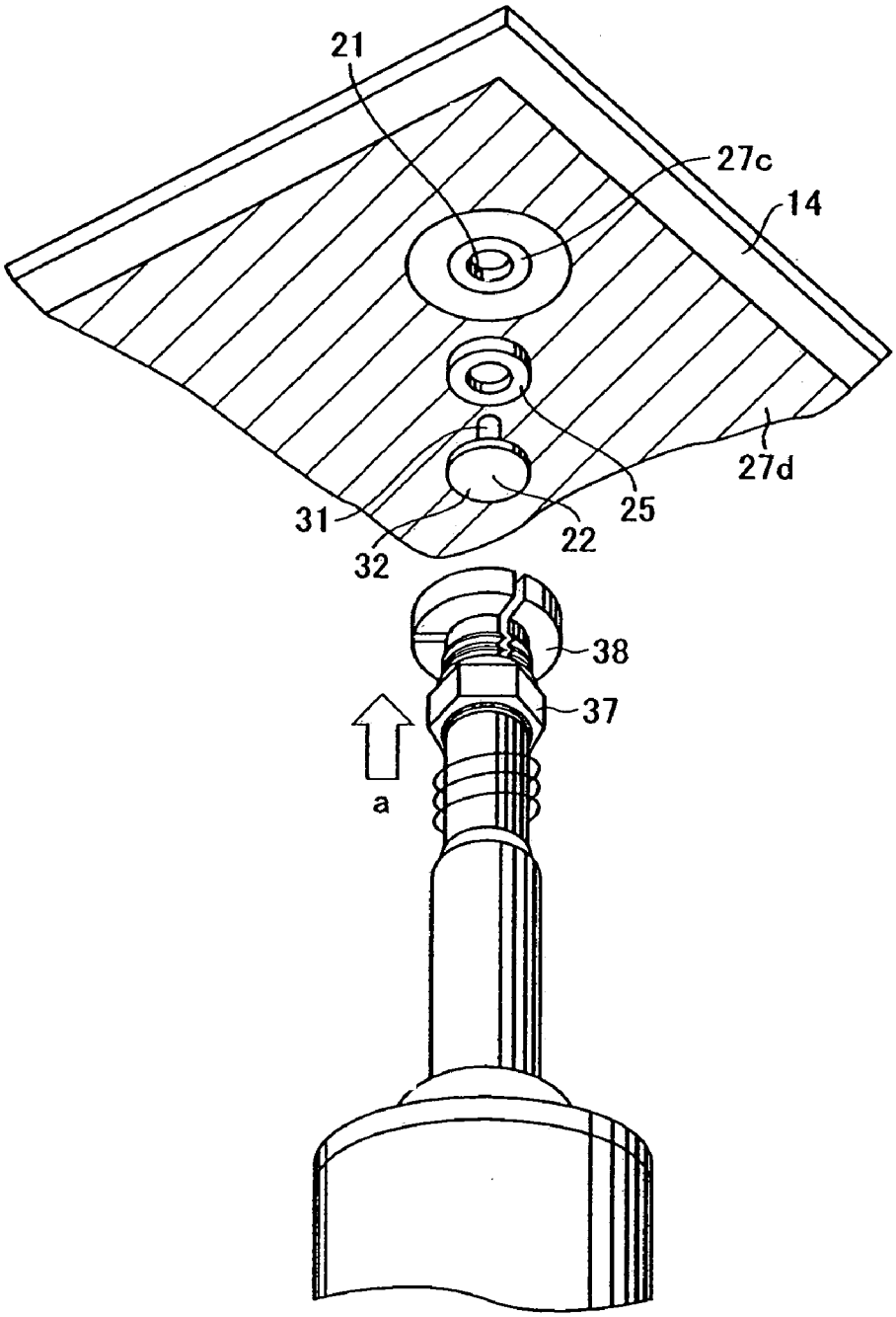
FIG. 4 is a perspective view representing the assembly of a voltage application structure using an ultrasonic soldering iron.

A method for assembling the aforementioned voltage application structure 11 will be described with reference to the drawings. FIG. 4 is a perspective view showing the condition that the voltage application structure 11 is assembled using an ultrasonic soldering iron, and FIGS. 5A to 5D show the steps of assembling the voltage application structure 11.

Figure 5A:
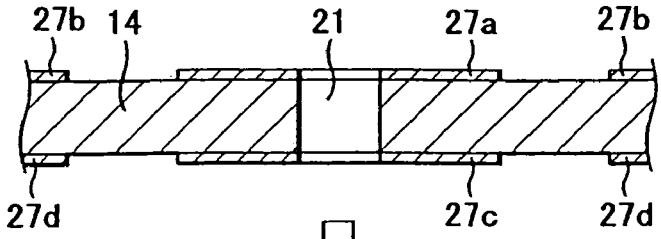
FIGS. 5A to 5D are vertical sectional views for illustrating steps of assembling the aforementioned voltage application structure.

As shown in FIG. 5A, each of the metal pastes 27*a* and 27*b* are applied by printing onto an inner surface of a cathode (not shown in the drawing) side of the rear plate 14, likewise, each of the metal pastes 27*c* and 27*d* are applied by printing onto an outer surface of the rear plate 14, and firing is performed at 420° C. for 10 minutes.

Figure 5B:
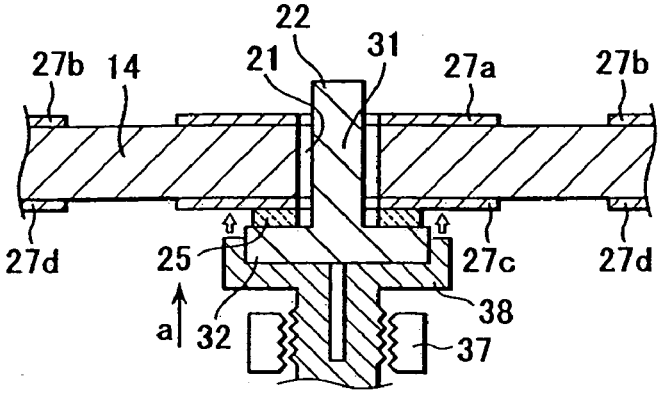
Figure 5C:
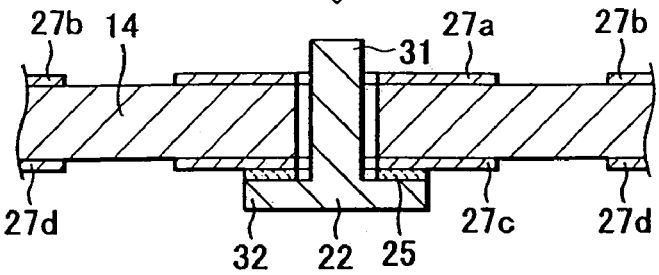

As shown in FIG. 4, flange portion 32 of the metal pin 22 is attached to a holding portion 38 of an ultrasonic soldering iron 37 and is held thereby. As shown in FIG. 5B and FIG. 5C, the joining material 25 is held between the flange portion 32 and the rear plate 14, the ultrasonic soldering iron 37 is moved in the direction indicated by an arrow as shown in FIG. 4, the axis portion 31 of the metal pin 22 is inserted into the penetration hole 21 from the outer surface side of the rear plate 14 and therefore, the metal pin 22 held by the holding portion 38 of the ultrasonic soldering iron 37 is arranged.

The ultrasonic soldering iron 37 is heated and, therefore, the temperature is raised to 160° C. at which indium, preferably included in the joining material 25, is melted. After the joining material 25 is melted, ultrasonic vibration is applied by the ultrasonic soldering iron 37 while the ultrasonic soldering iron 37 is moved and, therefore, the axis portion 31 of the metal pin 22 is pushed into the penetration hole 21 of the rear plate 14. Subsequently, the joining material 25 is cooled to room temperature.

Figure 5D:
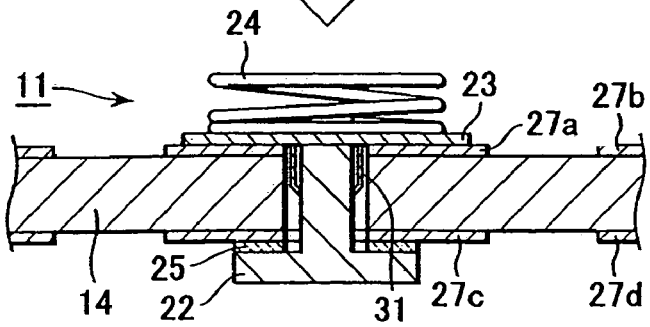

After the joining material 25 is cooled adequately, the holding portion 38 of the ultrasonic soldering iron 37 is removed from the flange portion 32 of the metal pin 22. Subsequently, as shown in FIG. 5D, the metal plate 23 and the helical compression spring 24 are fitted to the axis portion 31 of the metal pin 22 from the inner surface side of the rear plate 14, and thereby the voltage application structure 11 is completed.

As described above, by using the ultrasonic soldering iron 37, oxide layers at junction interfaces among the joining material 25, metal pastes 27*a* and 27*c*, and the flange portion 32 of the metal pin 22 are broken so as to form and perform diffusion-junction, and therefore excellent (highly reliable) junctions can be established. By the metal pin 22 being held with the holding portion 38 of the ultrasonic soldering iron 37, the heating temperature and ultrasonic wave by the ultrasonic soldering iron 37 can be applied to the joining material 25 and the junction interfaces. According to this procedure, the metal pin 22 can be joined to the penetration hole 21 in the rear plate 14 with high hermeticity, and therefore, a voltage can be reliably and efficiently applied to the hermetic container 10.

The faceplate 13 and the rear plate 14 are positioned by arranging spacers (not shown), etc., therebetween, if necessary, to face each other, and the perimeter thereof is sealed.

As described above, according to the display device 1 of the first embodiment, since the voltage application structure 11 includes the metal pin 22, metal plate 23, helical compression spring 24, and each of the metal pastes 27*a*, 27*b*, 27*c*, and 27*d* enclosing the perimeter of these structures, and manufacture is performed using the ultrasonic soldering iron 37, the junction interface which seals the penetration hole 21 can be reduced to one place, and therefore the probability of junction failure and electrical leakage can be substantially minimized or reduced. Consequently, according to this display device 1, the yield in manufacture can be improved and, therefore, further inexpensive display devices can be provided.

(Second Embodiment)

Figure 6:
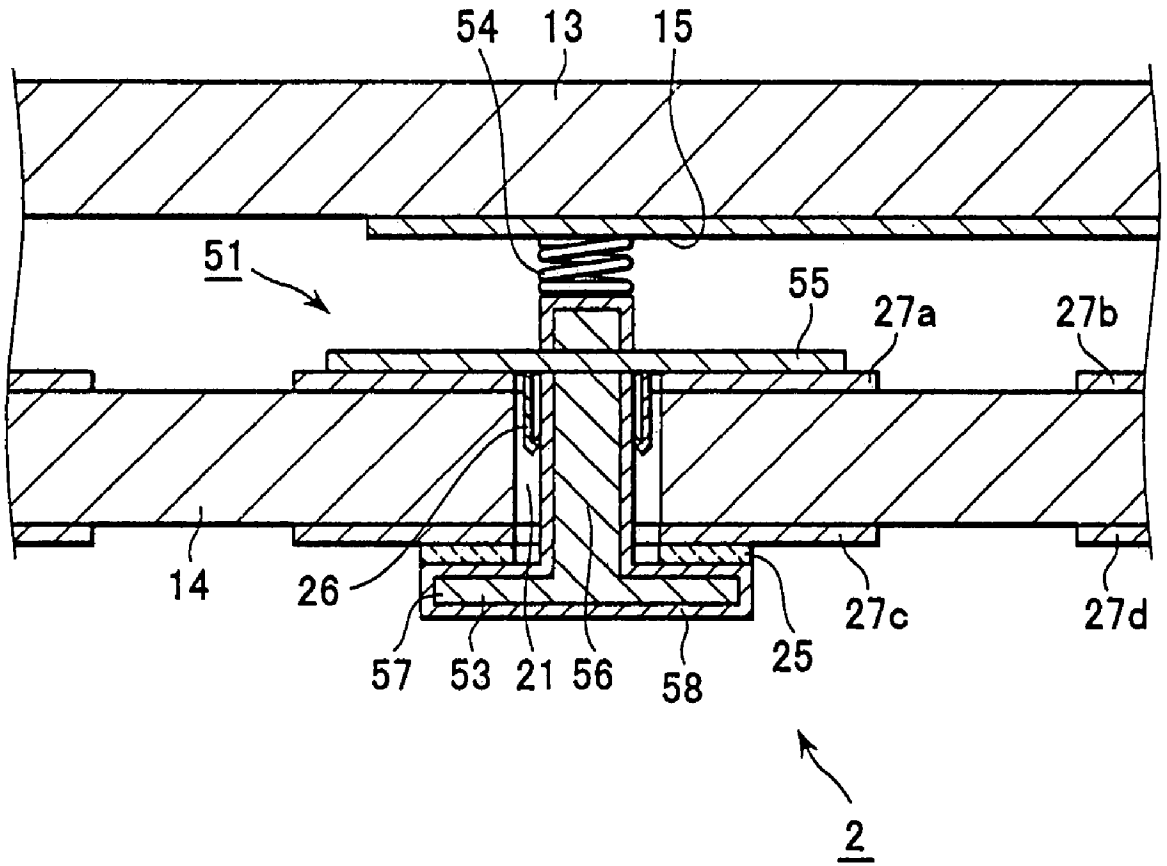
FIG. 6 is a vertical sectional view showing a portion of a hermetic container arranged in a display device according to a second embodiment of the present invention.

Next, a display device of the second embodiment provided with another voltage application structure according to this invention will be described. Since this display device of the second embodiment has the same basic configuration as that of the aforementioned display device 1 of the first embodiment, except for part of the voltage application structure, the same members are indicated by the same reference numerals, and explanations thereof are not repeated hereafter. FIG. 6 shows a vertical sectional view of the voltage application structure according to the second embodiment.

As shown in FIG. 6, a voltage application structure 51 arranged in a display device 2 of the second embodiment includes a glass pin 53 which is at least partially contained by insertion of at least a part thereof in a penetration hole 21 in a rear plate 14, and which is for supplying an electric potential to an anode 15, a metal plate 55 electrically connected to this glass pin 53, and a helical compression spring 54 electrically connected to this metal plate 55.

The glass pin 53 includes an axis portion 56 which is a small diameter portion to be inserted through the penetration hole 21, and a nearly disk-shaped flange portion 57 which is a large diameter portion integrally arranged on a base end side of this axis portion 56. The glass pin 53 is formed from a material, for example, PD200 (manufactured by ASAHI GLASS CO., LTD.), to have the axis portion 56 on the order of 1.5 mm in diameter and the flange portion 57 on the order of 5 mm in diameter. Regarding the glass pin 53, thermal expansion thereof is allowed to nearly agree or be consistent with the thermal expansion of a glass material (a thermal expansion coefficient of $8.0\times10^{-6}$/° C. to $9.0\times10^{-6}$/° C.) which has formed the rear plate 14, and therefore the thermal stress generated during manufacture of the voltage application structure 51 is relaxed.

The surface of the glass pin 53 is covered with a conductive plating 58 for improving junction strength by improving wettability with respect to a joining material 25. As the conductive plating 58, for example, an electroless nickel plating on the order of 3 μm thick is applied, and thereafter electroless gold plating on the order of 0.05 μm thick is applied all over the outer surface of glass pin 53.

The flange portion 57 of the glass pin 53 is joined onto the outer surface of the rear plate 14 with the joining material 25 therebetween. As the joining material 25, frit preferably is used. By allowing only one place between the glass pin 53 and a metal paste 27*c* to become a junction surface of the voltage application structure 51, the probability of occurrence of electrical leakage and reduction of strength due to junction failure can be substantially minimized or reduced.

One end of the helical compression spring 54 is joined onto a tip of the axis portion 56 of the glass pin 53 by laser spot welding. The helical compression spring 54 is formed into the shape of 2 mm in natural length and 1.2 mm in outer diameter from, for example, a piano wire of 0.2 mm in wire diameter. Regarding the voltage application structure 51, since a structure of helical compression spring is adopted, even when the length of the spring is reduced, relatively large stroke can be achieved by increasing the pitch of spring. Consequently, the elastic force is allowed to function with stability even in a relatively small area specific to the low-profile flat-panel display device 2.

As described above, the glass pin 53 and the helical compression spring 54 are integrally configured, and therefore occurrence of faulty continuity with the anode 15 due to poor contact between the glass pin 53 and the helical compression spring 54 is suppressed and avoided.

The metal plate 55 is manufactured by, for example, subjecting a stainless steel plate on the order of 6 mm in diameter and 0.05 mm in thickness to an etching treatment. The perimeter of this metal plate 55 is warped by press working, and therefore good contact with an inner surface side metal paste 27*a* is ensured. This metal plate 55 includes a center hole (not shown in the drawing) for containing the axis portion 56 of the glass pin 53 by insertion, and the socket 26 is arranged in this center hole by engaging elements in contact therewith.

Regarding the voltage application structure 51 configured as described above, a voltage is applied from the outer surface side of the rear plate 14, and is applied to the anode 15 via the glass pin 53 with the axis portion 56 being contained in the penetration hole 21 by insertion through the socket 26, metal plate 55, and helical compression spring 54.

Electrons emitted from the cathode on the rear plate 14 into a vacuum are accelerated by applying a voltage to the anode 15, and come into collision with fluorophors arranged on the anode 15 so as to bring about light emission. Consequently, information, for example, images, is displayed on the display portion arranged in the display device 2.

Regarding the aforementioned voltage application structure 51, since the joining material 25 has electrical conductivity, the metal paste 27*c* has nearly the same electric potential as that of the glass pin 53, and the metal paste 27*a* is allowed to have nearly the same electric potential as that of the glass pin 53 by being brought into contact with the metal plate 55 having the same electric potential as that of the glass pin 53. On the other hand, the metal pastes 27*b* and 27*d* are grounded. This is for stabilizing the electric potential of the total voltage application structure 51 by enclosing with a conductive metal paste having a regulated voltage, and thereby determining the reference of electric potential.

Regarding the voltage application structure 51, when structures, glass pin 53 and helical compression spring 54, are enclosed by virtue of, and sealed by, each of the metal pastes 27*a*, 27*b*, 27*c*, and 27*d* on the perimeter of the penetration hole 21, an electric field convergence which can occur at protrusion-shaped portions of structures, etc., resulting from the shape is alternatively brought to the metal pastes 27*a*, 27*b*, 27*c*, and 27*d* with end portions being likely to form into smooth shapes, and therefore occurrence of discharge resulting from the electric field convergence can be suppressed.

A method for assembling the aforementioned voltage application structure 51 by using frit as the joining material 25 will be described.

Each of the metal pastes 27*a* and 27*b* are applied by printing onto the inner surface of the cathode side of the rear plate 14, likewise, each of the metal pastes 27*c* and 27*d* are applied by printing onto the outer surface of plate 14, and firing is performed at 420° C. for 10 minutes.

In advance, a holding portion 38 is screwed into an ultrasonic soldering iron. The flange portion 57 of the glass pin 53 is attached to the holding portion 38 of the ultrasonic soldering iron 37 and is held. The joining material 25 is held between the flange portion 57 and the rear plate 14, the ultrasonic soldering iron 37 is moved so as to insert the axis portion 56 of the glass pin 53 into the penetration hole 21 from the outer surface side of the rear plate 14 and, therefore, the glass pin 53 held by the holding portion 38 of the ultrasonic soldering iron 37 is arranged.

The ultrasonic soldering iron 37 is heated and, therefore, the temperature is raised to 420° C. at which frit, the joining material 25, is melted. When localized heating is brought about by the ultrasonic soldering iron 37, the possibility of any resulting cracking in the rear plate 14 can be suppressed and at least reduced by raising the temperature of the total rear plate 14 to the vicinity of 350° C. with a hot plate (not shown in the drawing).

After the joining material 25 is melted, ultrasonic vibration is applied by the ultrasonic soldering iron 37 while the ultrasonic soldering iron 37 is moved, and therefore the axis portion 56 of the glass pin 53 is pushed into the penetration hole 21 of the rear plate 14. Subsequently, the joining material 25 is cooled to room temperature.

After the joining material 25 is cooled adequately, the holding portion 38 of the ultrasonic soldering iron 37 is removed from the flange portion 57 of the glass pin 53. Subsequently, the metal plate 55 and the helical compression spring 54 are fitted to the axis portion 56 of the glass pin 53 adjacent the inner surface side of the rear plate 14, and thereby the voltage application structure 51 is completed.

As described above, by using the ultrasonic soldering iron 37, oxide layers at junction interfaces among the joining material 25, metal pastes 27*a* and 27*c*, and the flange portion 57 of the glass pin 53 are broken so as to provide and perform diffusion-junction, and therefore, a high quality junction can be established. By the glass pin 53 being held with the holding portion 38 of the ultrasonic soldering iron 37, the heating temperature and ultrasonic wave provided by the ultrasonic soldering iron 37 can be adequately and sufficiently applied to the joining material 25 and junction interfaces. According to this aspect of the invention, the glass pin 53 can be joined to the penetration hole 21 in the rear plate 14 with high hermeticity, and therefore a voltage can be applied reliably and efficiently to the hermetic container.

As described above, according to the display device 2 of the second embodiment, since the voltage application structure 51 includes the glass pin 53, metal plate 55, helical compression spring 54, and each of the metal pastes 27*a*, 27*b*, 27*c*, and 27*d* enclosing the perimeter of these structures, and manufacture is performed using the ultrasonic soldering iron 37, the junction interface which seals the penetration hole 21 can be reduced to one place, and therefore the probability of junction failure and electrical leakage can be substantially minimized or reduced. Consequently, according to this display device 2, the yield in manufacture can be improved, and therefore further inexpensive display devices can be provided.

(Third Embodiment)

Figure 7:
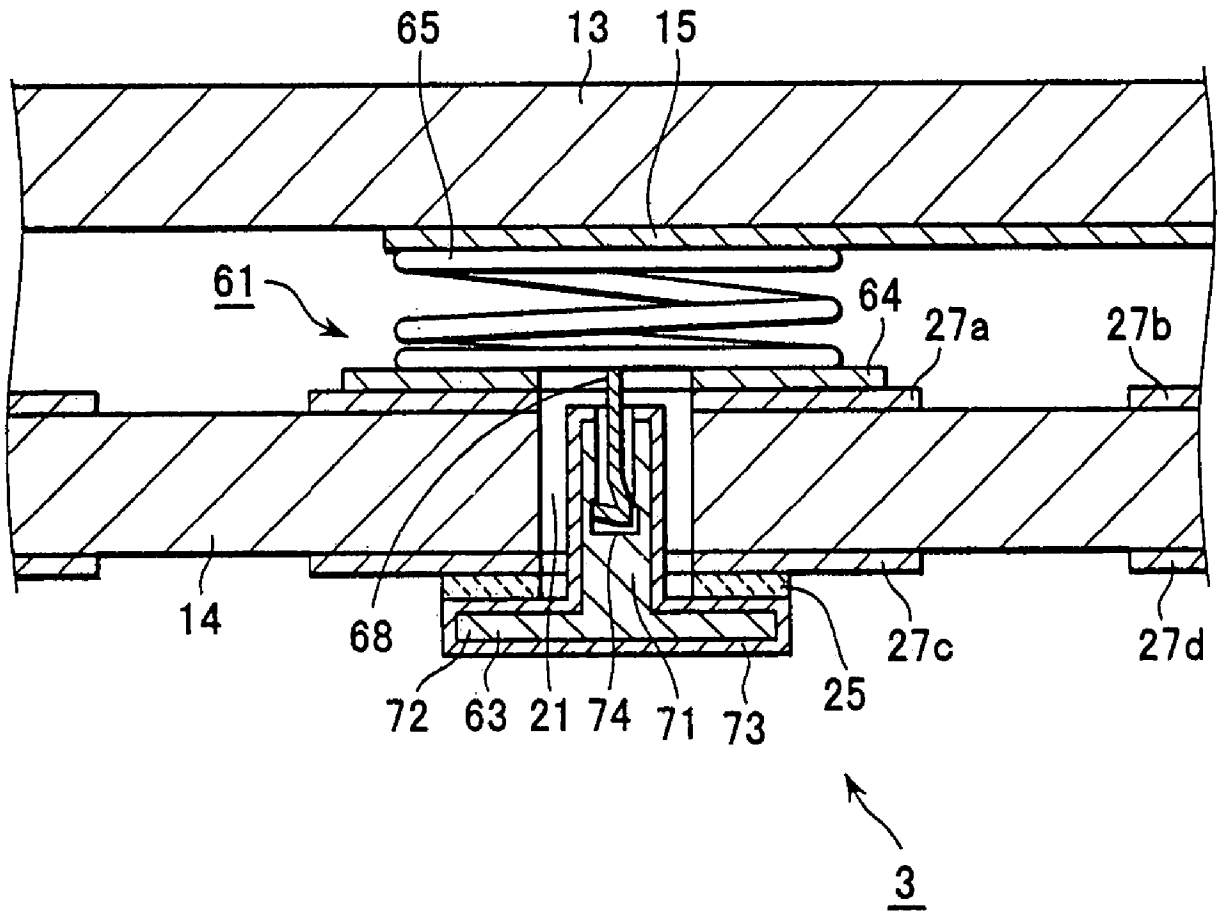
FIG. 7 is a vertical sectional view showing a portion of a hermetic container arranged in a display device according to a third embodiment of the present invention.
Figure 8:
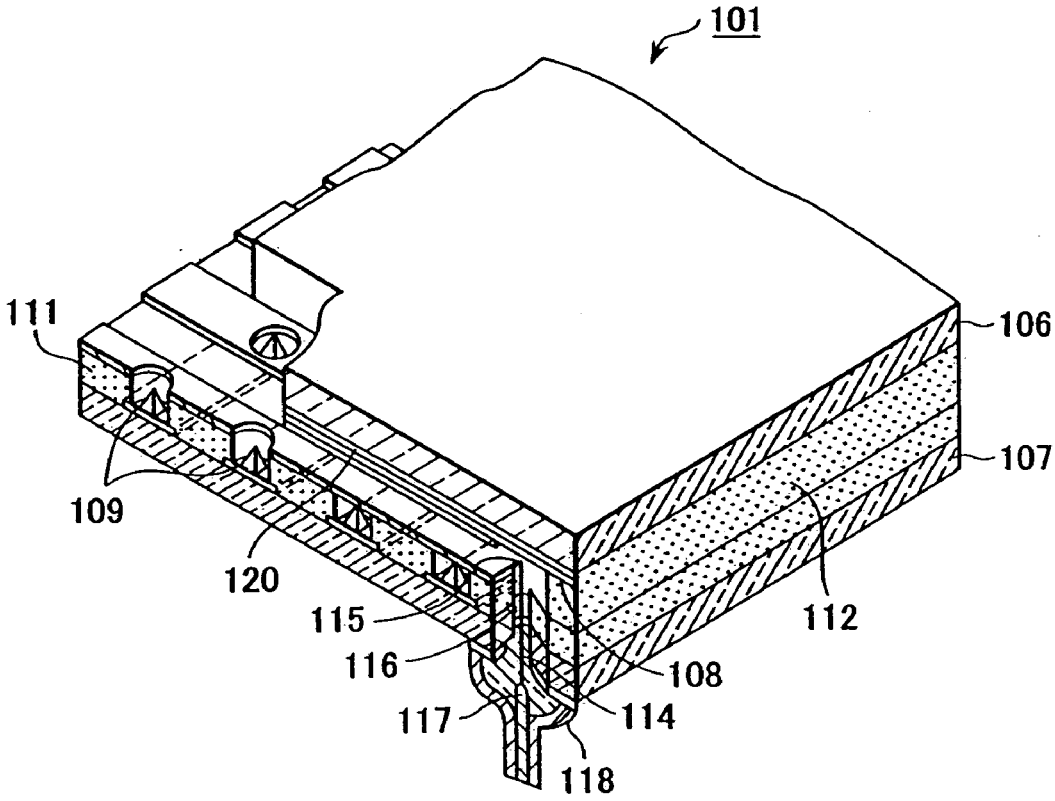
FIG.8 PRIOR ART
FIG. 8 is a perspective view showing a portion of a conventional display device.

A display device of a third embodiment provided with another voltage application structure will now be described. Since this display device of the third embodiment has the same basic configuration as that of the aforementioned display device of the first embodiment, except for the voltage application structure, the same elements as those described above are indicated by the same reference numerals as those set forth above and further explanations thereof will not be provided. FIG. 7 shows a vertical sectional view of the voltage application structure.

As shown in FIG. 7, a voltage application structure 61 arranged in a display device 3 of the third embodiment includes a metal pin 63, (second conductive member) at least part of which is contained by insertion in a penetration hole 21 in rear plate 14, and which is for supplying an electric potential to an anode 15, a metal plate 64 electrically connected to this metal pin 63, and a helical compression spring 65 electrically connected to this metal plate 64.

The metal pin 63 includes an axis portion 71 which is a small diameter portion to be inserted through the penetration hole 21, and a nearly disk-shaped flange portion 72 which is a large diameter portion integrally arranged at a base end side of this axis portion 71. The metal pin 63 may include, for example, a 47Ni—Fe alloy (a thermal expansion coefficient of $3.0\times10^{-6}$/° C. to $5.5\times10^{-6}$/°C.) as a material. For example, metal pin 63 may be made of a 47Ni—Fe alloy having a thermal expansion coefficient of $5.5\times10^{-6}$/° C. The axis portion 71 preferably is formed to have a diameter on the order of 1.5 mm, and the flange portion 72 preferably is formed to have a diameter on the order of 5 mm. Since a glass material having a thermal expansion coefficient of $8.0\times10^{-6}$/° C. preferably is used as the glass material constituting the rear plate 14, the difference between the thermal expansion of the metal pin 63 and the thermal expansion of the glass material forming the rear plate 14 becomes $2.5\times10^{-6}$/° C. This is within $3.0\times10^{-6}$° C., and therefore any thermal stress generated during manufacture of the voltage application structure 61 is relaxed or at least substantially reduced.

In the axis portion 71 of the metal pin 63, an engagement hole 74, in which a part of a metal plate 64 is engaged, is arranged (provided) by processing a tip side or end of the axis portion 71 in parallel with an axis direction of portion 71. This engagement hole 74 is formed to have a hole diameter on the order of 0.6 mm while being processed so that the hole diameter is increased by 1.5 times at a center part of the axis portion 71.

The surface of the metal pin 63 is covered with a conductive plating 73 for improving junction strength by improving wettability with respect to the joining material 25. As the conductive plating 73, for example, an electroless nickel plating on the order of 3 μm thick is applied, and thereafter, electroless silver plating on the order of 0.05 μm thick is applied all over an outer surface of the metal pin 63, except for inside of the engagement hole 74.

The flange portion 72 of the metal pin 63 is joined onto an outer surface of the rear plate 14 with the joining material 25 therebetween. As the joining material 25, for example, lead solder is used. By allowing only one place between the metal pin 63 and a metal paste 27*c* to become a junction surface of the voltage application structure 61, the probability of occurrence of electrical leakage and reduction of strength due to junction failure can be substantially reduced or minimized.

The helical compression spring 65 is joined onto the main surface of the metal plate 64 by laser spot welding. The helical compression spring 65 is formed into the shape of 7 mm in natural length and 4 mm in outer diameter from, for example, a stainless steel wire of 0.2 mm in wire diameter. Regarding the voltage application structure 61, since a structure of helical compression spring is adopted, even when the length of the spring is reduced, a relatively large stroke can be achieved by increasing the pitch of spring. Consequently, the elastic force is allowed to function with stability even in a relatively small area specific to the low-profile flat-panel display device 3.

The metal plate 64 is manufactured by, for example, subjecting a stainless steel plate on the order of 5 mm in diameter and 0.05 mm in thickness to an etching treatment. At a center portion of the main surface of this metal plate 64, a hook 68 engaged in the engagement hole 74 in the axis portion 71 of the metal pin 63 is integrally arranged. This hook 68 is formed from, for example, a stainless steel wire on the order of 0.2 mm in wire diameter, and is joined to the center portion of the main surface of the metal plate 64 by welding. The hook 68 may be formed, for example, by cutting and raising up a part of the main surface of this metal plate 64. The hook 68 ensures continuity and coupling between the metal pin 63 and the metal plate 64 by being engaged in the engagement hole 74 of the metal pin 63.

The metal plate 64 is positioned by engaging the hook 68 in the engagement hole 74 in the axis portion 71 of the metal pin 63, and after a faceplate 13 is arranged, the metal plate 64 is pressed against the rear plate 14 side by the helical compression spring 65 welded thereto. Consequently, the metal plate 64 is positioned with further reliability so as to be arranged in a desired position.

Regarding the voltage application structure 61 configured as described above, a voltage is applied from an external voltage source (not shown) outside of the outer surface side of the rear plate 14, and is applied to the anode 15 via the metal pin 63 with the axis portion 71 being contained in the penetration hole 21 by insertion through the hook 68, metal plate 64, and helical compression spring 65.

Electrons emitted from the cathode (not shown) on the rear plate 14 into a vacuum are accelerated by applying a voltage to the anode 15, and come into collision with fluorophors arranged on the anode 15 so as to bring about light emission. Consequently, information, for example, images, is displayed on the display portion arranged in the display device 3.

Since the aforementioned voltage application structure 61 has a continuity structure in which the helical compression spring 65, hook 68, metal plate 64, and metal pin 63 are independent of one another, the helical compression spring 65 can be arranged regardless of the precision or imprecision of the arrangement position of the metal pin 63 relative to the rear plate 14, and therefore the elastic force of the helical compression spring 65 can be exerted with stability. Furthermore, since the helical compression spring 65, hook 68, metal plate 64, and metal pin 63 are independent of one another in the configuration, the helical compression spring 65 and metal plate 64 can be installed after the metal pin 63 is installed, and therefore structural deformations during installation-processing of the metal pin 63 can be prevented.

Since the joining material 25 has electrical conductivity, a metal paste 27*c* has nearly the same electric potential as that of the metal pin 63, and a metal paste 27*a* is allowed to have nearly the same electric potential as that of the metal pin 63 by being brought into contact with the metal plate 64 having the same electric potential as that of the metal pin 63. On the other hand, metal pastes 27*b* and 27*d* are grounded. This is for stabilizing the electric potential of the total voltage application structure 61 by enclosing (sealing) with the conductive metal pastes having a regulated voltage, and thereby determining the reference of electric potential of the structure 61.

Regarding the voltage application structure 61, when structures, such as the metal pin 63 (at least a portion thereof) and helical compression spring 65 are enclosed and sealed by virtue of the metal pastes 27*a*, 27*b*, 27*c*, and 27*d* on the perimeter of the penetration hole 21, an electric field convergence which can occur at protrusion-shaped portions of the structures, etc., resulting from the shape is alternatively brought to the metal pastes 27*a*, 27*b*, 27*c*, and 27*d*, which have end portions likely to form into smooth shapes, and therefore occurrence of discharge resulting from the electric field convergence, can be suppressed.

A method for assembling the aforementioned voltage application structure 61 using lead solder as the joining material 25 will be described.

Each of the metal pastes 27*a* and 27*b* are applied by printing onto the inner surface (on the cathode side of the rear plate 14). Likewise, each of the metal pastes 27*c* and 27*d* are applied by printing onto the outer surface of the rear plate 14, and firing is performed at 420° C. for 10 minutes.

The flange portion 72 of the metal pin 63 is attached to a holding portion 38 of an ultrasonic soldering iron 37 and is held. The joining material 25 is held between the flange portion 72 and the rear plate 14, the ultrasonic soldering iron 37 is moved so as to insert the axis portion 71 of the metal pin 63 into the penetration hole 21 from the outer surface side of the rear plate 14, and thereby the metal pin 63 held by the holding portion 38 of the ultrasonic soldering iron 37 is arranged.

The ultrasonic soldering iron 37 is heated, and the temperature is raised to 160° C., at which lead solder (i.e., the joining material 25) is melted. After the joining material 25 is melted, ultrasonic vibration is applied by the ultrasonic soldering iron 37 while the ultrasonic soldering iron 37 is moved, and as a result the axis portion 71 of the metal pin 63 is pushed into the penetration hole 21 of the rear plate 14. Subsequently, the joining material 25 is cooled to room temperature.

After the joining material 25 is cooled adequately, the holding portion 38 of the ultrasonic soldering iron 37 is removed from the flange portion 72 of the metal pin 63. Subsequently, the metal plate 64 and the helical compression spring 65 are fitted to the axis portion 71 of the metal pin 63 adjacent the inner surface side of the rear plate 14, and thereby the voltage application structure 61 is completed.

As described above, by using the ultrasonic soldering iron 37, oxide layers at junction interfaces among the joining material 25, metal pastes 27*a* and 27*c*, and the flange portion 72 of the metal pin 63 are broken so as to provide and perform diffusion-junction, and therefore a good quality junction can be established. By the metal pin 63 being held with the holding portion 38 of the ultrasonic soldering iron 37, the heating temperature and ultrasonic wave provided by the ultrasonic soldering iron 37 can be applied to the joining material 25 and the junction interfaces. According to this, the metal pin 63 can be joined to the penetration hole 21 in the rear plate 14 with high hermeticity, and therefore a voltage can be applied efficiently and reliably to the hermetic container 10.

As described above, according to the display device 3 of the third embodiment, since the voltage application structure 61 includes the metal pin 63, metal plate 64, helical compression spring 65, and each of the metal pastes 27*a*, 27*b*, 27*c*, and 27*d* enclosing and sealing the perimeter of these structures, and since manufacture is performed using the ultrasonic soldering iron 37, a junction interface which seals the penetration hole 21 can be reduced to one place or area, and therefore the probability of junction failure and electrical leakage can be substantially minimized or reduced. Consequently, according to this display device 3, the yield in manufacture can be improved, and therefore further inexpensive display devices can be provided.

Having described the first through third embodiments of the invention, it is noted that each of the voltage application structures arranged in the display devices according to the present invention is configured to include a helical compression spring. However, in other embodiments the devices, may instead include, for example, other springs, e.g., leaf springs, conductive elastic materials, or other suitable components.

As described above, according to the present invention, the flat-panel display device (e.g., 1) is provided with a hermetic container including a cathode for emitting electrons and the anode electrode (e.g., 15) to be supplied with an externally-supplied) electric potential. The display device includes the anode substrate (faceplate) (e.g., 13) provided with the aforementioned anode electrode, the cathode substrate (rear plate) (e.g., 14) which is arranged facing the anode substrate at a predetermined spacing therefrom, and which is provided with the aforementioned cathode, and the first conductive member (e.g., 22, 31, and 56). The first conductive member is used as an anode terminal for supplying an electric potential to the aforementioned anode electrode from an external voltage source (outside of the outer surface side of the cathode substrate) through the penetration hole 21 in the cathode substrate. The aforementioned first conductive member (e.g., 22, 31, and 56) includes the axis portion (e.g., 31) located in the aforementioned penetration hole (e.g., 21) and the flange portion (e.g., 32 and 57), which, in a preferred embodiment, is integral with the axis portion and is located outside of the aforementioned penetration hole, adjacent the outer surface side of the cathode substrate. Furthermore, the first conductive member is joined to the aforementioned cathode substrate while the aforementioned flange portion and outer surface of the cathode substrate are brought into intimate contact with each other.

By virtue of the construction of the display device 1 of this invention, the occurrence of junction failure and electrical leakage can be suppressed or at least substantially minimized, and therefore a configuration in which the hermetic container keeps hermeticity with ease can be realized.

When the second conductive member electrically connected to the aforementioned axis portion is arranged, and the second conductive member is in contact with an adjacent opening end of the aforementioned penetration hole extending between opposing inner facing side surfaces of the aforementioned cathode substrate (edge portions of the substrate, where inner facing surfaces thereof face the penetration hole), discharge at the edge portions can be prevented.

When the display device is provided with the conductive elastic member (e.g., 24, 54, 65) arranged at a location between the aforementioned first conductive member and the aforementioned anode electrode, and electrically connected to each of the first conductive member and the anode electrode, the hermetic container can be assembled with ease while the reliability of the electrical connection is improved.

More preferably, the aforementioned first conductive member preferably includes a base material having a thermal expansion coefficient of $2.0\times10^{-6}$/° C. or more, but $12.0\times10^{-6}$/° C. or less, from the viewpoint of improvement of reliability in electrical characteristics and hermetic characteristics.

More preferably, the aforementioned flange portion is provided with the conductive film for improving wettability with respect to the aforementioned joining material formed between and joining the film and the cathode substrate 14, from the viewpoint of improvement of the hermeticity.

According to the present invention, a flat-panel display device is provided with the hermetic container including the cathode for emitting electrons and the anode electrode to be supplied with an externally-derived electric potential. The display device includes the anode substrate provided with the aforementioned anode electrode, the cathode substrate arranged facing the anode substrate at a predetermined spacing from the substrate, and which is provided with the cathode (not shown), the penetration hole which is arranged in (through) the aforementioned cathode substrate and through which is supplied an electric potential to the aforementioned anode electrode from outside of the outer surface side of the cathode substrate, the anode terminal arranged in the penetration hole and electrically connected to the aforementioned anode electrode, and the conductive member in contact with the opening end of the aforementioned penetration hole on the inner surface side of the aforementioned cathode substrate (that is, the edge portion of the substrate inner surface and the penetration hole). The aforementioned conductive member is electrically connected to the aforementioned anode terminal and is supplied with an electric potential from the anode terminal.

Owing to this configuration, the occurrence of junction failure and electrical leakage can be suppressed or at least substantially reduced or minimized, and therefore the configuration in which the hermetic container keeps hermeticity with ease can be realized.

The aforementioned conductive member includes the conductive film arranged on the inner surface of the aforementioned cathode substrate and the plane-shaped member in contact with the conductive film, and the socket arranged on the plane-shaped member and the axis portion to become the aforementioned anode terminal are fitted with each other.

According to this configuration, assembling of the hermetic container becomes easy.

Consequently, according to the present invention, the yield of the hermetic container in manufacture of the hermetic container can be improved, and therefore, further inexpensive display devices, hermetic containers, and the methods for manufacturing the hermetic containers can be provided.

While the present invention has been described with reference to what are presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest reasonable interpretation so as to encompass all such modifications and equivalent structures and functions.

What is claimed is:

1. A flat-panel display device including a hermetic container provided with a cathode for emitting electrons and an anode electrode to be supplied with an electric potential, the flat-panel display device comprising:

an anode substrate provided with the anode electrode;

a cathode substrate arranged facing the anode substrate at a predetermined spacing therefrom, and provided with a layer and the cathode; and a structure comprising (a) a portion which is joined to the layer formed on a surface of the cathode substrate by a joining member, which surface is a reverse side relative to a surface facing the anode substrate, and (b) a conductive portion extending through a penetration hole in the cathode substrate and through which the electric potential is supplied to the anode electrode, wherein the structure and the cathode substrate are hermetically coupled together by joining with the joining member, the joining member comprises indium, and the layer comprises a metal.

2. A flat-panel display device according to claim 1, wherein the portion joined to the layer has a conductivity.

3. A flat-panel display device according to claim 1, wherein the layer is formed from paste.

* * * * *

UNITED STATES PATENT AND TRADEMARK OFFICE

CERTIFICATE OF CORRECTION

PATENT NO. : 7,154,216 B2
APPLICATION NO. : 11/242845
DATED : December 26, 2006
INVENTOR(S) : Kinya Kamiguchi It is certified that error appears in the above-identified patent and that said Letters Patent is hereby corrected as shown below:

ON THE TITLE PAGE, ITEM (73) ASSIGNEE:

Assignee, "Canon Kanushiki Kaisha, Tokyo (JP)" should read --Canon Kabushiki Kaisha, Tokyo (JP)--.

COLUMN 7:

Line 32, "0.7.5 x $10^{-6}$/°C." should read --7.5 x $10^{-6}$/°C.--.

COLUMN 13:

Line 26, "3.0 x $10^{-6}$° C.," should read -- 3.0 x $10^{-6}$/°C--.

Signed and Sealed this

Eighteenth Day of March, 2008

JON W. DUDAS
*Director of the United States Patent and Trademark Office*